US007226267B2

(12) United States Patent
Johnston

(10) Patent No.: US 7,226,267 B2
(45) **Date of Patent: *Jun. 5, 2007**

(54) MATERIAL RELOCATION APPARATUS

(76) Inventor: Gary Lawrence Johnston, P.O. Box 183, Cowarts, AL (US) 36321

( * ) Notice: Subject to any disclaimer, the term of this patent is extended or adjusted under 35 U.S.C. 154(b) by 0 days.

This patent is subject to a terminal disclaimer.

(21) Appl. No.: 11/131,110

(22) Filed: May 17, 2005

(65) Prior Publication Data

US 2005/0201853 A1 Sep. 15, 2005

Related U.S. Application Data

(63) Continuation of application No. 10/236,132, filed on Sep. 6, 2002, now Pat. No. 6,896,472, which is a continuation-in-part of application No. 09/725,773, filed on Nov. 29, 2000, now abandoned, which is a continuation-in-part of application No. 09/505,799, filed on Feb. 17, 2000, now abandoned.

(51) Int. Cl.
*B66F 9/12* (2006.01)

(52) U.S. Cl. ..... 414/607; 414/642; 414/703

(58) Field of Classification Search ..... 414/607, 414/640, 647, 703, 723, 642
See application file for complete search history.

(56) References Cited

U.S. PATENT DOCUMENTS 3,187,912 A * 6/1965 McKnight ..... 414/703
4,302,139 A * 11/1981 Malish ..... 414/24.5
5,064,248 A * 11/1991 Tegtmeier ..... 298/11
5,076,368 A * 12/1991 Harrell ..... 172/219
5,209,002 A * 5/1993 Tranquilli et al. ..... 37/442
5,580,208 A * 12/1996 Miller, Sr. ..... 414/703
6,032,746 A * 3/2000 Lowery ..... 172/445.1
6,200,083 B1 * 3/2001 Hein ..... 414/607
6,520,730 B1 * 2/2003 Davenport ..... 414/686
6,663,338 B1 * 12/2003 Gregory et al. ..... 414/703

* cited by examiner

*Primary Examiner*—Charles A. Fox

(57) ABSTRACT

A material relocation apparatus is provided which enables an operator to load, transport, and unload material, while the apparatus may be moving in the forward and backward directions. The apparatus includes a frame structure means, a material relocation means, and a power transfer means, with the material handling means and the power transfer means being mounted to the frame structure means. The material relocation means is a conventional type of load bucket, commonly found on construction equipment. It is pivotally mounted to the rear of the frame structure means, and is capable of being pivoted in both the forward and backward directions via the power transfer means. The power transfer means is a conventional type of power cylinder and piston mounted to the front of the frame structure means. The apparatus may attach to a tractor, or be a built-in component of a piece of construction equipment. A wheel assembly may be an optional component of the apparatus.

6 Claims, 11 Drawing Sheets

MATERIAL RELOCATION APPARATUS

CROSS REFERENCE TO RELATED APPLICATIONS

This application is a continuation of U.S. patent application Ser. No. 10/236,132 filed on Sep. 6, 2002, which issued as U.S. Pat. No. 6,896,472 on May 24, 2005. U.S. patent application Ser. No. 10/236,132 is a continuation in part of U.S. patent application Ser. No. 09/725,773 filed on Nov. 29, 2000, now abandoned which is itself a continuation in part of U.S. patent application Ser. No. 09/505,799 filed on Feb. 17, 2000, and also now abandoned.

BACKGROUND OF THE INVENTION

This invention relates to a material relocation apparatus which may be used to load and unload material in both the forward and backward directions. There are instances where relatively smaller amounts of material, such as soil, rock, debris, etc., may need to be transported from one location to another. This device allows an easy way for the material to be loaded, transported, and then unloaded, using a light construction device such as a tractor. The apparatus may also be part of a motorized vehicle whose main purpose is to load, transport, and unload material. Given the fact that there are a large number of light construction equipment and farm equipment available in the marketplace, it has come as a surprise that no one has developed an easy and effective piece of equipment which allows relatively smaller amounts of material to be easily loaded and unloaded in both the forward and backward directions.

SUMMARY AND OBJECTS OF THE INVENTION

It is the object of this invention to provide a material relocation apparatus which may be used to load, transport, and unload relatively smaller amounts of material from one location to another. The main purpose of this application is to demonstrate an apparatus which performs the stated function, and to demonstrate the many options and configurations this apparatus may take on.

Briefly stated, the apparatus that forms the basis of the present invention comprises a frame structure means, a material handling means, and a power transfer means. The material handling means and the power transfer means are mounted upon the frame structure means. The frame structure means may also include an attachment component for attaching the apparatus to a motorized piece of equipment, such as a farm or construction tractor, a bull dozer, etc. Alternately, the apparatus may be a built-in component of a motorized vehicle whose primary purpose is to load, transport, and unload material.

The design of the apparatus is such that the material handling means is pivotally mounted on the device frame, and the power transfer means is used to pivotally move the material handling means in both the forward and backward directions. The power transfer means may itself be rigidly mounted to the frame structure means, with a portion pivoting in the upward and downward directions. Alternately, the entire power transfer means may be pivotally mounted to the frame structure means and pivotally move in the upward and downward directions. In either instance, material may be loaded into the material handling means while the apparatus is being pulled or pushed, with the material handling means being positioned in either the respective forward or backward directions. The material handling means may also be positioned upright so that material is contained within the material handling means. The material may then be transported to another location and unloaded, in either the forward or backward direction.

Other objects, features, and advantages for this invention will be apparent from the following detailed description and the appended claims, references being made to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction or arrangement of parts illustrated in the accompanying drawings, since the invention is capable of other embodiments and of being practiced or carried out in various ways. Also, it is to be understood that the phraseology and terminology employed herein is for the purpose of description, and not limitation.

Figure 1A:
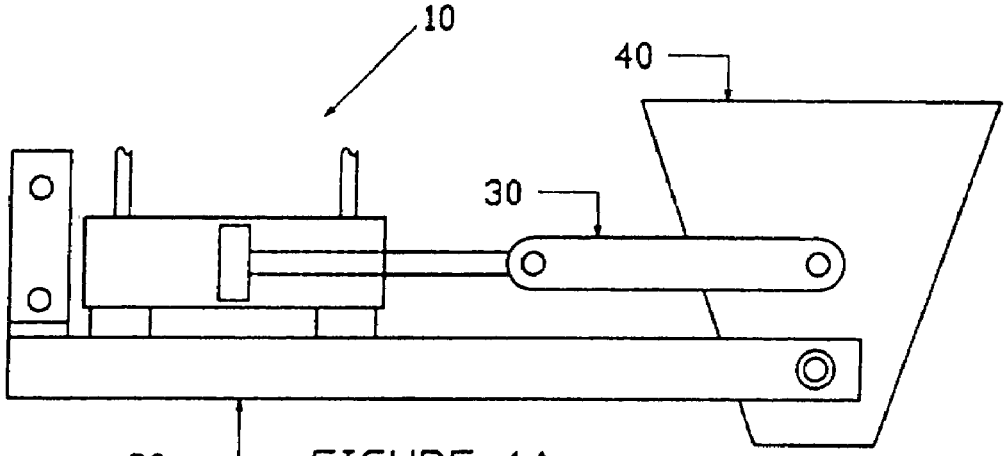
FIG. 1A is a side view of the material relocation apparatus.
Figure 1B:
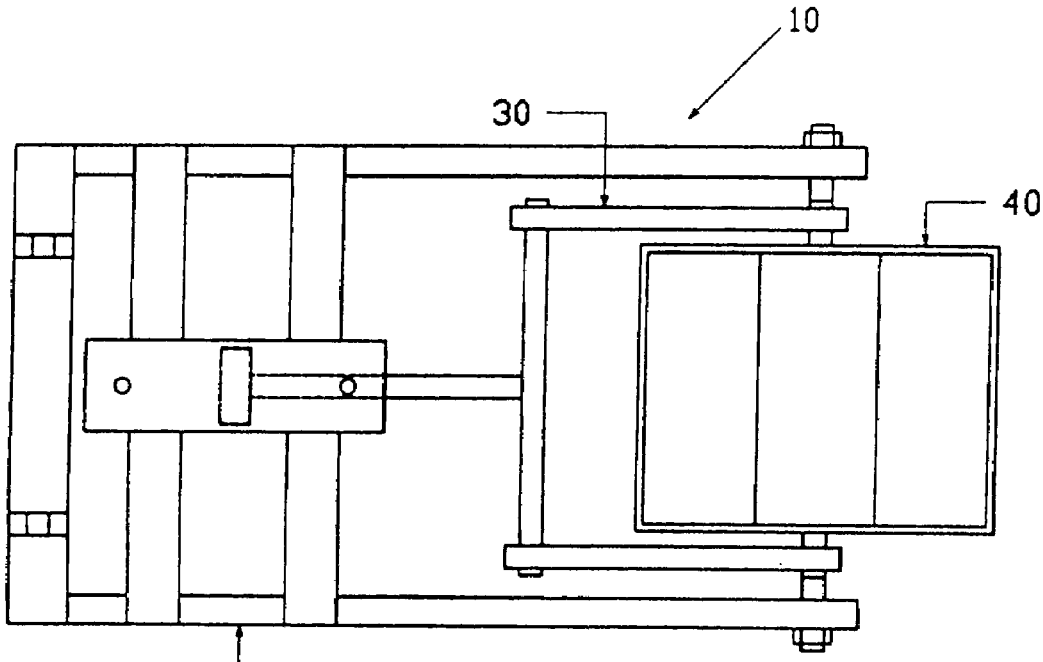
FIG. 1B is a top view of the material relocation apparatus.
Figure 1C:
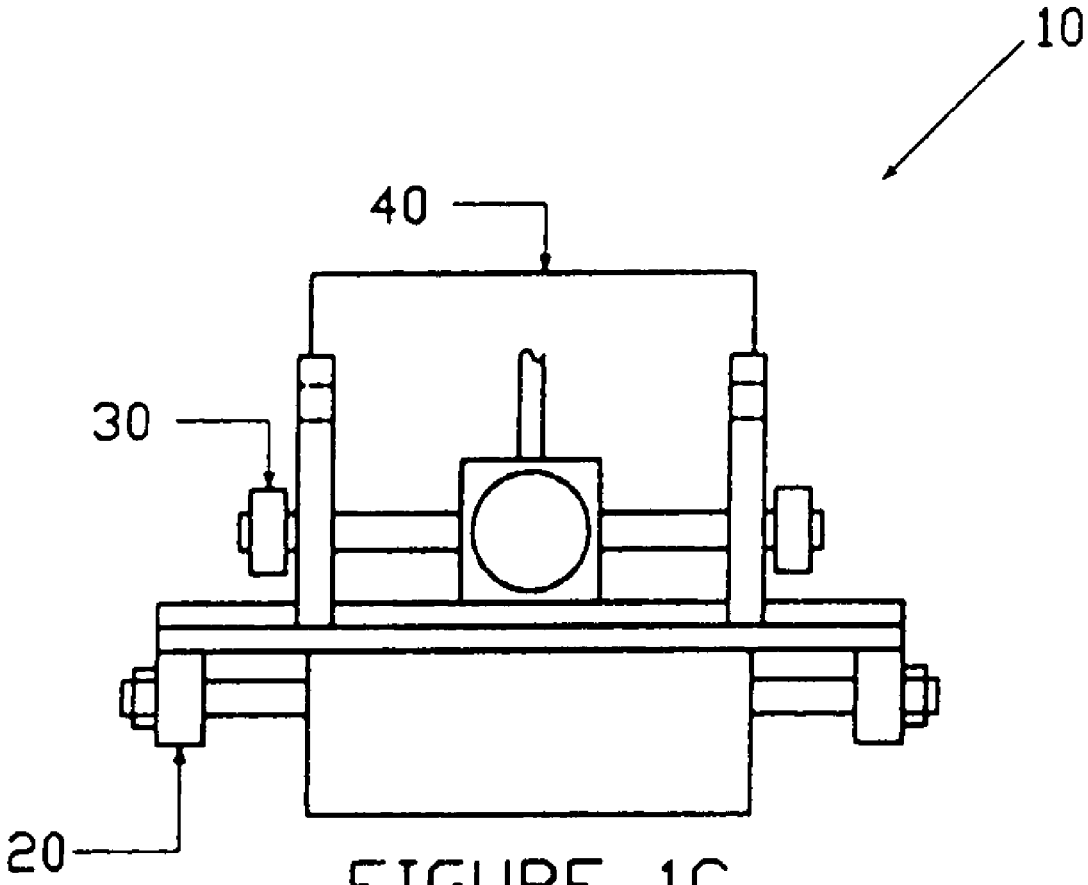
FIG. 1C is a front view of the material relocation apparatus.

As best can be seen by references to the drawings, and in particular to FIGS. 1A–1C, the material relocation apparatus that forms the basis of the present invention is designated generally by the reference numeral 10, and includes a frame structure means 20, a material handling means 40, and a power transfer means 30. The power transfer means 30 and the material handling means 40 mount upon frame structure means 20.

Figure 2A:
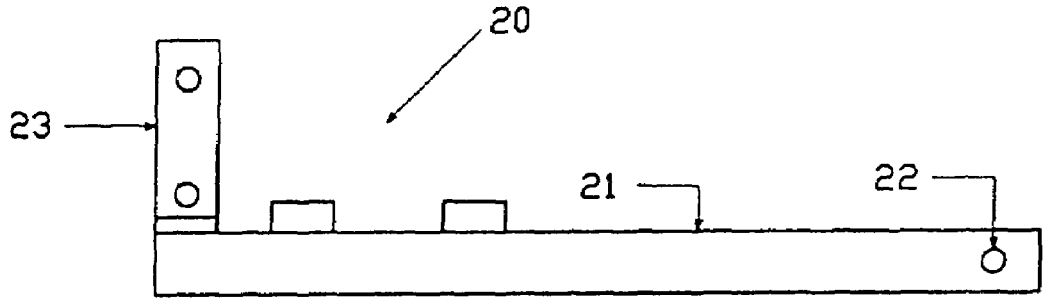
FIG. 2A is a side view of the frame structure means of the material relocation apparatus.
Figure 2B:
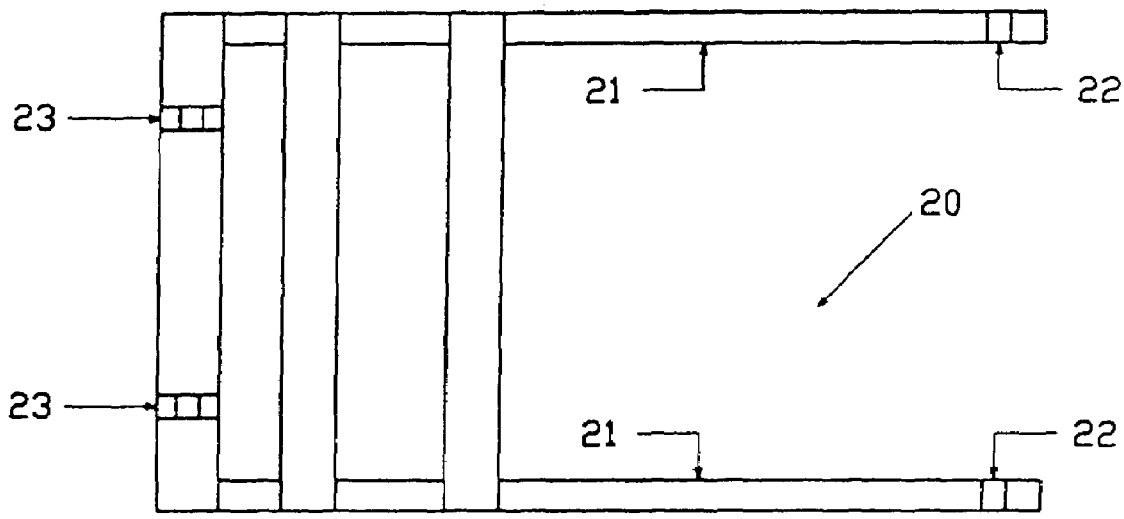
FIG. 2B is a top view of the frame structure means of the material relocation apparatus.
Figure 2C:
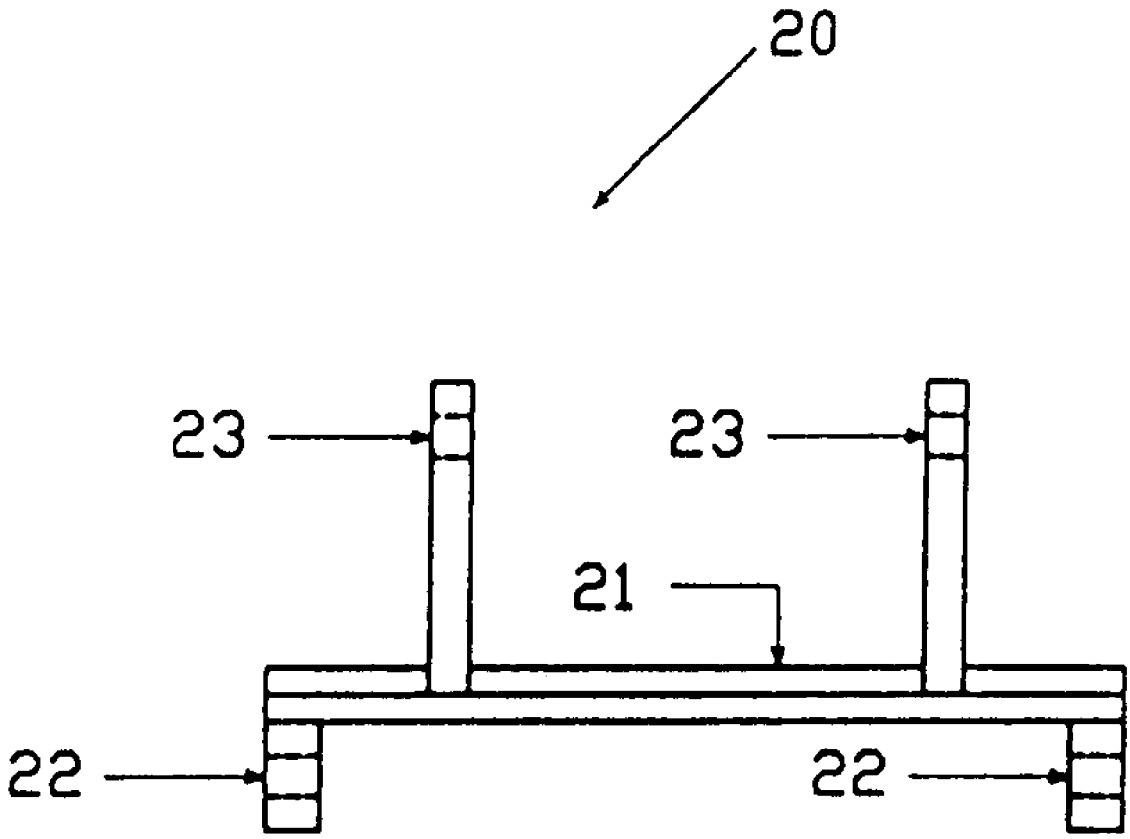
FIG. 2C is a front view of the frame structure means of the material relocation apparatus.

As may been seen in FIGS. 2A–2C, frame structure means 20 may comprise a base 21 with base openings 22. Attachment component 23 is an optional type item which mounts to base 21 and may be used to mount the apparatus to a motorized vehicle, such as a tractor. As previously stated, the apparatus may also be a built-in component of a motorized vehicle whose primary purpose is to load, transport, and unload material. In these cases, the attachment component is not needed.

Figure 3A:
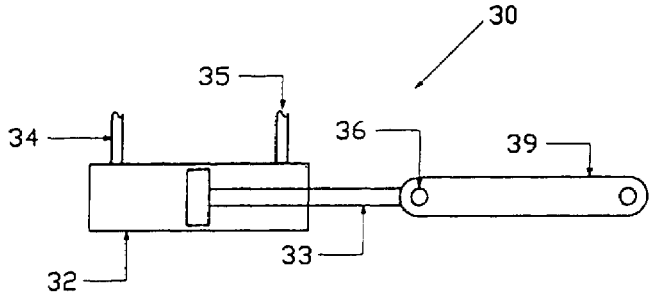
FIG. 3A is a side view of the water collection means of the material relocation apparatus.
Figure 3C:
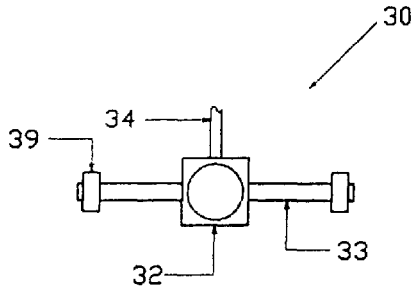
FIG. 3C is a front view of the power transfer means of the material relocation apparatus.
Figure 3B:
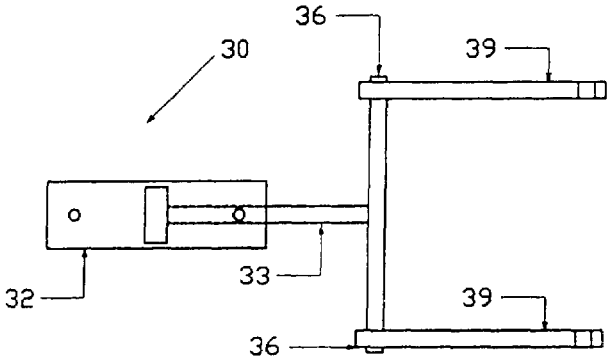
FIG. 3B is a top view of the power transfer means of the material relocation apparatus.

As may also be seen in FIGS. 3A–3C, the power transfer means 30 may comprise a power component 31 with linkage member 39. Power component 31 is a typical cylinder-actuator (cylinder-piston) type power component well known in the industry, and is comprised of an air-tight cylinder 32, actuator 33, first tube 34, and second tube 35. In this particular design, cylinder 32 is rigidly mounted to base 21, while linkage member 39 is pivotally mounted at one end to actuator 33, through linkage openings 36. As will be shown later, other configurations are possible.

Figure 4A:
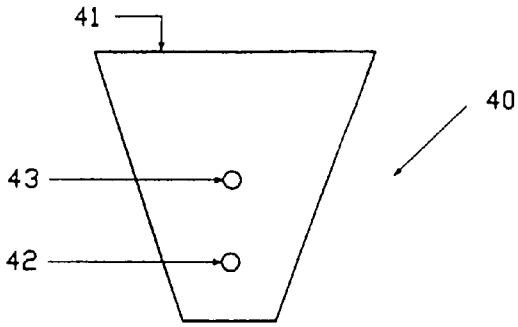
FIG. 4A is a side view of the material handling means of the material relocation apparatus.
Figure 4C:
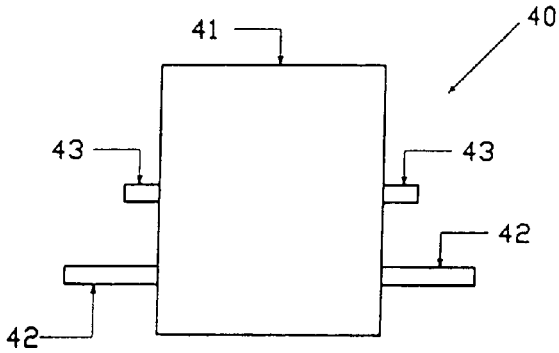
FIG. 4C is a front view of the material handling means of the material relocation apparatus.
Figure 4B:
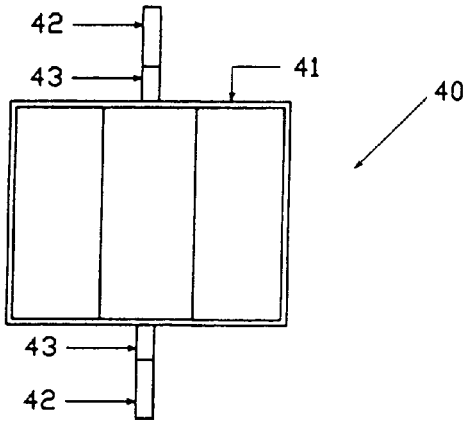
FIG. 4B is a top view of the material handling means of the material relocation apparatus.

As may be seen in FIGS. 4A–4C, the material handling means 40 is comprised of a handling component 41 with pivot members 42 and engagement members 43. Pivot members 42 are used to pivotally mount handling component 41 to structure frame means 20, while engaging members 43 are used to pivotally mount linkage member 39 of power transfer means 30 to the handling component 41. Handling component 41 is a typical bucket means commonly used in the construction industry.

Figure 5A:
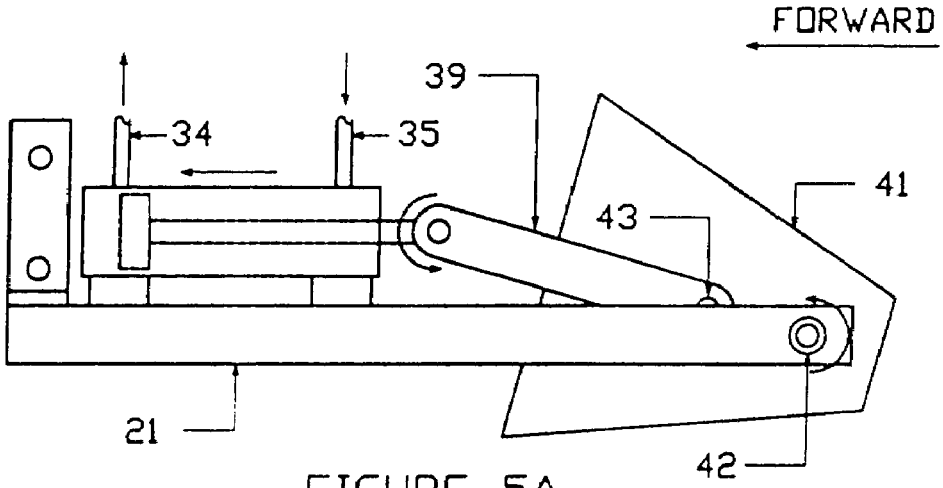
FIG. 5A is a side view of the material handling means of the material relocation apparatus in a position where it may be used to load or unload material in the forward direction.
Figure 5B:
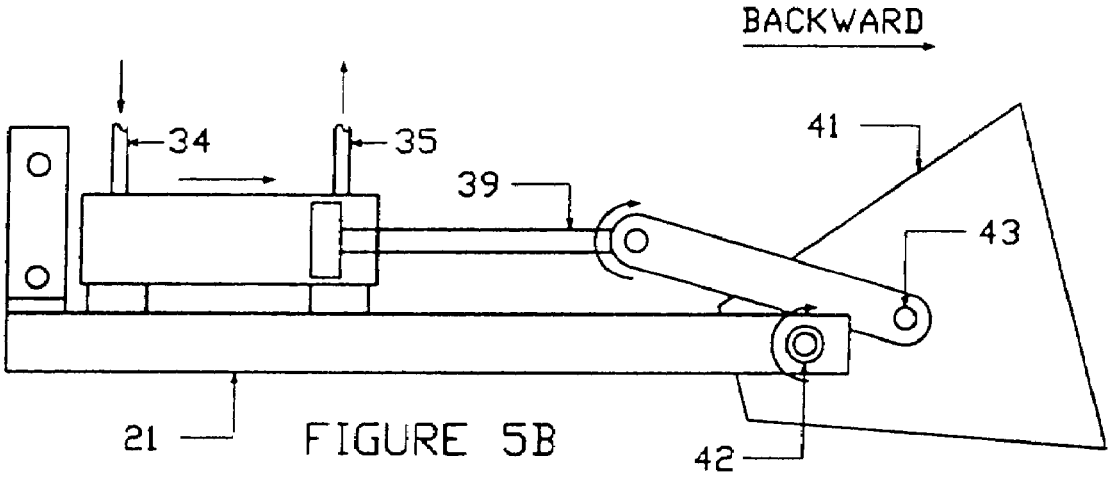
FIG. 5B is a side view of the material handling means of the material relocation apparatus in a position where it may be used to load or unload material in the backward direction.
Figure 5C:
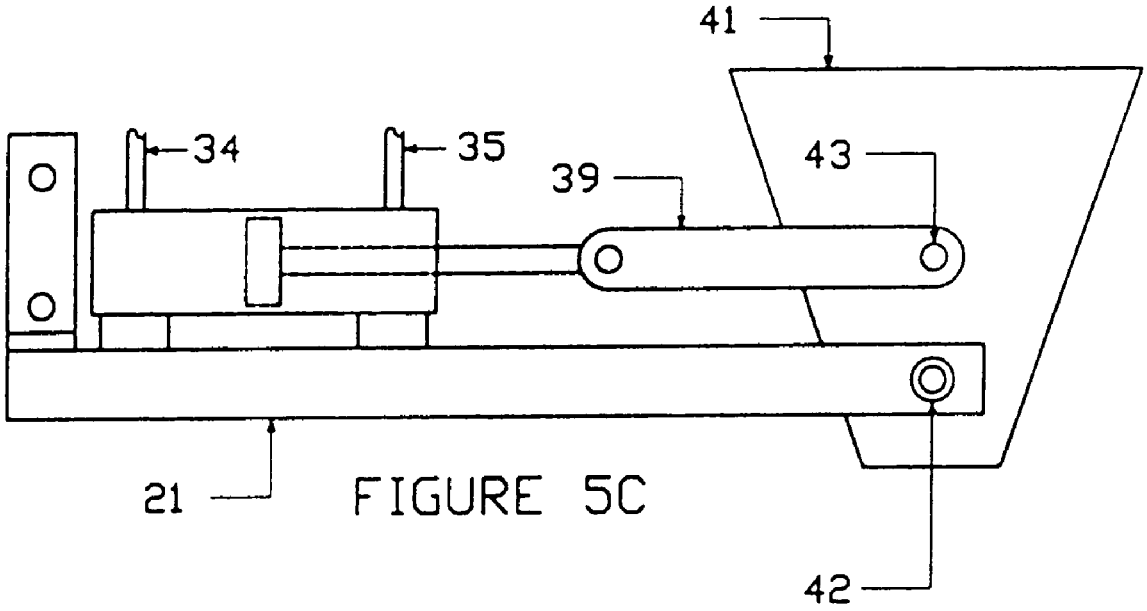
FIG. 5C is a side view of the material handling means of the material relocation apparatus in an upright position for transporting material from one location to another.

The operation of the material relocation apparatus 10 may be seen in FIGS. 5A, 5B, and 5C. As may be seen in FIG. 5A, the first tube 34 and second tube 35 may connect to the hydraulic supply of a piece of equipment, such as a tractor. Hydraulic fluid may be pumped into the cylinder 32 through second tube 35, and out of first tube 34, causing the actuator 33 to move in the forward direction. The actuator 33 will pull linkage member 39 in the forward direction. Since linkage member 39 is pivotally connected to handling component 41 through engagement members 43, and handling component 41 is pivotally mounted to base 21, handling component 41 will pivot in the forward direction. The open end of handling component 41 will be pointing in the generally forward direction when the actuator 33 is fully retracted. As material, such as soil, rock, and debris, come in contact with the material handling component 41 while in this position, with the apparatus moving forward, some of the material will begin to load into the material handling component 41. Also while in this position and with the apparatus moving forward, the handling component 41 may act as construction blade for leveling material.

As may be seen in FIG. 5B, hydraulic fluid may also be pumped into the cylinder 32 through first tube 34, and out of second tube 35, causing the actuator 33 to move in the backward direction. The actuator 33 will push linkage member 39 in the backward direction. Again, since the linkage member 39 is pivotally connected to the handling component 41, handling component 41 will pivot in the backward direction. The open end of handling component 41 will be pointing in the generally backward direction when the actuator 33 is fully extended. As material such as soil, rock, and debris come into contact with the material handling component 41 while in this position, with the apparatus moving backward, some of the material will begin to load into the material handling component 41. Also while in this position and with the apparatus moving backward, the handling component 41 may act as a construction blade for leveling material.

As may be seen in FIG. 5C, hydraulic fluid may be added to and removed from the cylinder so that the actuator is in a relatively middle position. This will result in the material handling component 41 being positioned relative upright, allowing the material being loaded to be contained within the component and transported to a different location. Once at the new location, the material may then be unloaded by positioning the material handling means 41 in one of the positions shown in FIGS. 5A and 5B, depending upon which direction of unloading is preferred. Also, material may be manually loaded into handling component 41 while in this relatively upright position. Various stops or blocks may be used to limit the amount handling component 41 may pivot in ther forward and bcakward directions.

Figure 6:
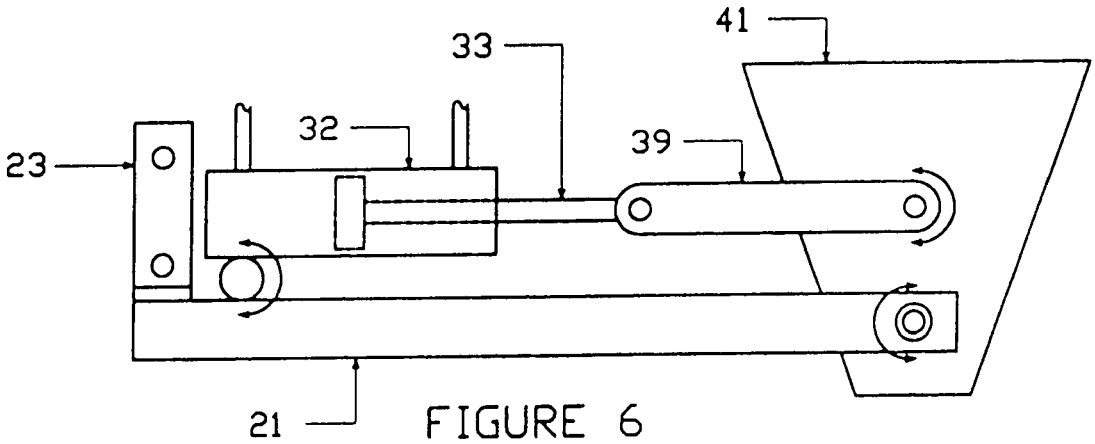
FIG. 6 is a side view of an alternative mounting configuration for the power transfer means of the material relocation apparatus.

FIG. 6 demonstrates another mounting configuration for the power transfer means 30. Shown in the previous diagrams is a cylinder 32 rigidly mounted to base 21, with a linkage member 33 pivotally mounted to the cylinder actuator 33. In this alternate configuration, the cylinder 33 is itself pivotally mounted to the base 21, with linkage member 33 now rigidly mounted to actuator 33. In this configuration, the entire power transfer means 30 pivots in the upward and downward directions, while before, only the linkage member 33 pivoted in the upward and downward directions. Therefore it may be said that in both configurations, at least a portion of the power transfer means 30 pivots in the upward and downward directions.

Figure 7:
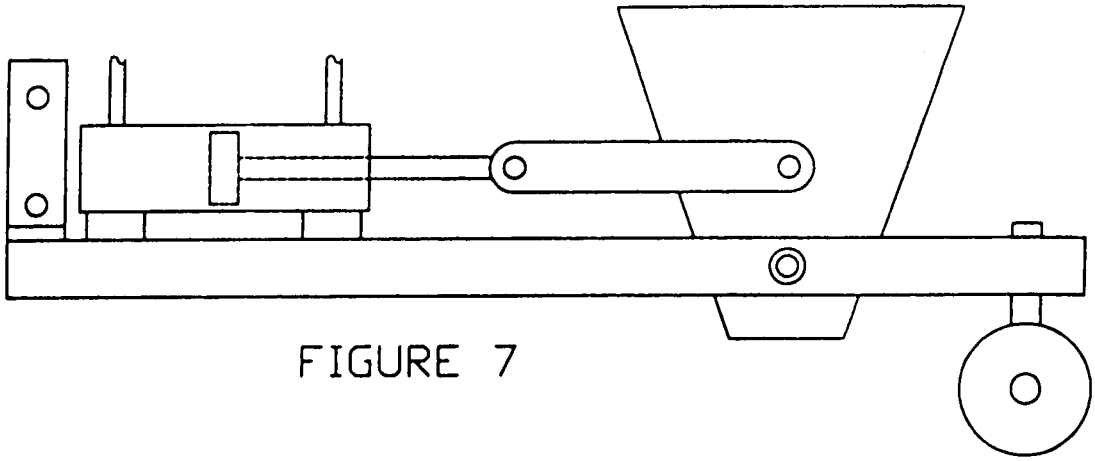
FIG. 7 is a side view of the material relocation apparatus having a wheel assembly.
Figure 8:
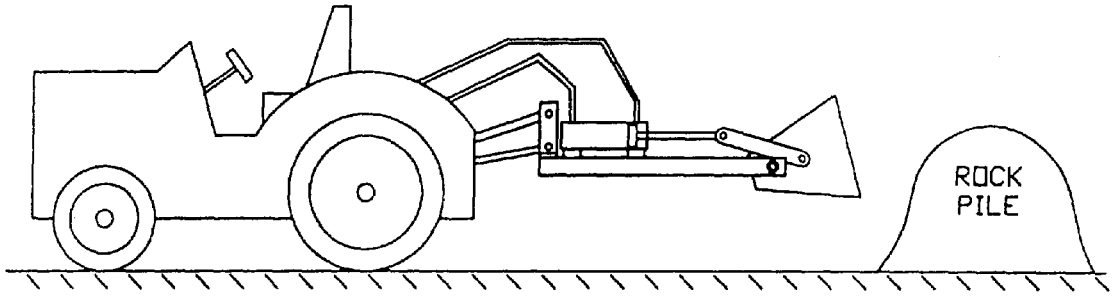
FIG. 8 is a side view of the material relocation apparatus being attached to the lift of a tractor.

FIG. 7 demonstrates a wheel assembly 50 which may be mounted to the base 21 to reduce the amount of load felt by the end of the motorized vehicle onto which the apparartus is attached or is a built-in component thereof. FIG. 8 demonstrates the material relocation apparatus attached to the lift 51 of a tractor.

Figure 9:
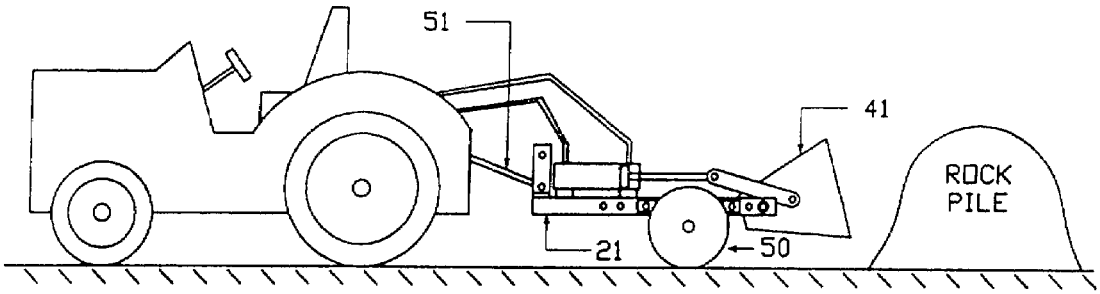
FIGS. 9 and 10 are side views of the material relocation apparatus being attached to the lift of a tractor and having a wheel assembly mounted to the frame structure means between the attachment means and bucket means. The figures demonstrate how a wheel assembly mounted this way will cause the bucket means to raise when the tractor lift is lowered, and will cause the bucket means to lower when the tractor lift is raised.
Figure 10:
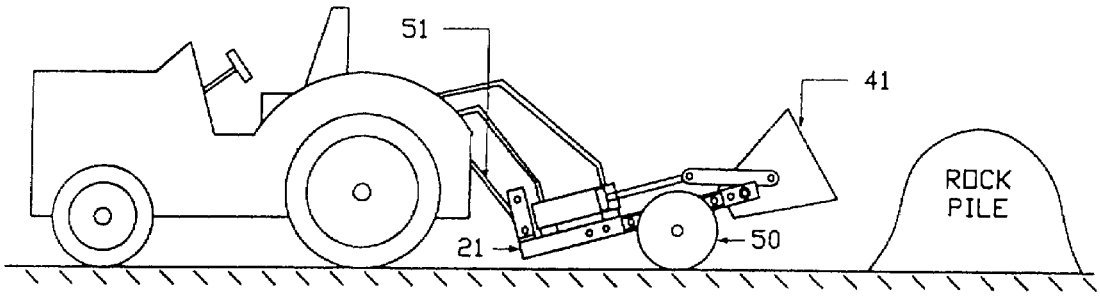

FIGS. 9 and 10 demonstrate the material relocation apparatus with a wheel asembly 50 mounted to the base 21 of frame structure means 20, to the general front of the material handling component 41. In this instance, the wheel assembly not only reduces the amount of load felt by the lifting end of the motorized vehicle, but also allows the operator to pivot the material handling component 41 about the wheel asembly 50. For example, when the apparatus is connected to the lift 51 of a tractor, raising the lift 51 will cause the material handling component to pivot downward, while lowering the lift 51 will cause the material handling component to pivot upward. This is opposite of the configuration where no wheel is used, or to where the wheel assembly 50 is mounted to the back of material handling component 41. The position of the wheel assembly 50 along the base 21 will determine the ratio of lift 51 travel distance to the material handling component 41 travel distance. It is possible to have a means for moving and securing the wheel assembly 50 at different intervals along base 21. The operator could configure the apparatus for the desired ratio of lift 51 travel distance to the material handling component 41 travel distance.

Many variations of the material relocation apparatus exist, along with the configurations described above. While it will be apparent that the preferred embodiment of the invention herein disclosed is well calculated to fulfill the objects above stated, it will be appreciated that the invention is susceptible to modification, variation, and change without departing from the proper scope or fair meaning of the subjoined claims.

I claim:

1. A material relocation apparatus comprising;

a frame structure means having a support member with a front area and a rear area;

a generally upright bucket means pivotally mounted at its general bottom center to the general rear area of said support member of said frame structure means;

a power transfer means comprising at least one conventional cylinder means having an accompanying piston means, said cylinder means mounted to the general front area of said support member of said frame structure means; and a linkage means for connecting said piston means and said bucket means, such that the extension of said piston means pivots said bucket means in the general backward direction, and the retraction of said pivot means pivots said bucket means in the general forward direction;

whereby said apparatus may be part of a motorized vehicle, or attached to a motorized vehicle through an attachment means mounted to the front area of said frame structure means, said motorized vehicle having a hydraulic supply operatively connected to said cylinder means, said hydraulic supply used to extend and retract said piston, with the open end of said bucket means pointing in the general backward direction when said piston means is fully extended, and the open end of said bucket means is pointing in the general forward direction when said piston means is fully retracted, with the point of connection between said linkage means and said bucket means forming a reciprocating arcuate path when said bucket means is pivoted.

2. A material relocation apparatus as claimed in claim 1, said cylinder means being pivotally mounted at its front end to said support member of said frame structure means, and said piston means being rigidly mounted at its rear end to a linkage member, said linkage member being pivotally mounted to said bucket means.

3. A material relocation apparatus as claimed in claim 1, said cylinder means being rigidly mounted at its front end to said support member of said frame structure means, and said piston being pivotally mounted at its rear end to said linkage member.

4. A material relocation apparatus as claimed in claim 1, said support member of said frame structure means having base openings, said bucket means having generally horizontal support components mounted at its bottom and extending in the side directions, said components sized to pivotally fit within the base openings of said support member such that said bucket means may be pivotally attached.

5. A material relocation apparatus as claimed in claim 1 further comprising a wheel assembly mounted to said support member of said frame structure means, at a location which is generally forward of said bucket means.

6. A material relocation apparatus as claimed in claim 5, said wheel assembly be securable at different locations along said support member of said frame structure means.

* * * * *